US005741165A

United States Patent [19]

Saito et al.

[11] Patent Number: 5,741,165

[45] Date of Patent: Apr. 21, 1998

[54] MARINE PROPULSION SYSTEM

[75] Inventors: Chitose Saito; Yasunari Okamoto, both of Hamamatsu, Japan

[73] Assignee: Sanshin Kogyo Kbushiki Kaisha, Hamamatsu, Japan

[21] Appl. No.: 789,527

[22] Filed: Jan. 27, 1997

Related U.S. Application Data

[63] Continuation-in-part of Ser. No. 609,174, Mar. 1, 1996.

[30] Foreign Application Priority Data

Mar. 3, 1995 [JP] Japan ..... 7-43974
Jan. 26, 1996 [JP] Japan ..... 8-033046

[51] Int. Cl.[6] ..... B63H 5/125

[52] U.S. Cl. ..... 440/57; 248/641

[58] Field of Search ..... 440/53, 55, 56, 440/57, 79, 900; 248/641

[56] References Cited

U.S. PATENT DOCUMENTS 1,789,415 1/1931 Phillips ..... 440/53
2,096,457 2/1937 Irgens .
4,367,860 1/1983 Strang ..... 248/641
4,549,869 10/1985 Iida et al. .

*Primary Examiner*—Jesus D. Sotelo
*Attorney, Agent, or Firm*—Knobbe, Martens, Olson & Bear LLP

[57] ABSTRACT

A number of embodiments of outboard drive systems that include a combined vertically extending drive shaft driven by the propulsion unit and which drives a generally horizontally extending propeller shaft that drives a propeller positioned substantially rearwardly of the transom. The propulsion system is supported for steering and trim movement about respective spaced apart axes and these axes are both disposed substantially below the transom of the associated watercraft. The propeller driven by the propeller shaft is disposed further from the trim axis than the forward end of a tiller that is affixed to the outboard drive for affecting the steering and trim movement.

8 Claims, 7 Drawing Sheets

MARINE PROPULSION SYSTEM

CROSS-REFERENCE TO RELATED APPLICATION

This application is a continuation in part of our copending application entitled "Outboard Marine Propulsion System", Ser. No. 08/609,174, filed Mar. 1, 1996, and assigned to the assignee hereof.

BACKGROUND OF THE INVENTION

This invention relates to a marine propulsion system and more particularly to the type of outboard propulsion system wherein the propulsion device is disposed substantially to the rear of the transom or hull of the associated watercraft.

A familiar type of outboard motor is adapted to be mounted on the transom of a watercraft and is pivotal about a generally vertically extending axis for steering and about a generally horizontally extending axis that is transverse to the steering axis for tilt and trim movement. With this more conventional type of outboard motor, the engine is mounted in the power head so that its output shaft rotates about a vertically extending axis. The output shaft is, in turn, connected in a lower unit and drive shaft housing assembly to a propulsion device that is disposed substantially vertically beneath the power head for propulsion of the watercraft. As a result, the propulsion device is positioned quite close to the transom or hull of the watercraft.

With another type of outboard motor, the propulsion device is driven primarily by a longitudinally extending drive shaft which is connected at its forward end to the engine output shaft. The engine is thus disposed with its output shaft extending at an acute angle to the horizontal. A propulsion device is carried at the rear end of the elongated drive shaft for propelling the watercraft. This type of outboard motor is also supported for steering movement about a vertical axis and for movement about a horizontal axis. The horizontal axis movement is not necessarily limited to tilt and trim movement, but may be employed so that the propeller or propulsion device can be easily lifted out of the body of water to clear underwater objects and for other reasons.

However, with this type of device the horizontal axis is disposed substantially at the upper portion of the transom and, hence, the elongated propeller shaft extends through a rather steep angle. Thus, the range of movement of the generally horizontally extending drive shaft is somewhat limited. In addition, the overall construction can intrude significantly into the hull of the watercraft. Also the mounting of the engine does not permit the use of conventional engines as used in the more conventional type of outboard motors.

Our aforenoted copending application is directed towards several embodiments of outboard marine propulsion systems that overcome the disadvantages of the prior art noted above. However, there is a still further problem in conjunction with the arrangement wherein the extension of the propeller shaft and the angle of it presents problems. When the shaft is lengthened, the boat tends to make contact with the bank when turning in narrow waterways or alternatively the extended propeller shaft will make such contact. This makes navigation in narrow waterways quite difficult.

It is, therefore, a principal object of the this invention to provide an improved marine propulsion system wherein the device may be kept relatively short and yet still can operate in shallow water and obtain the advantages of having the propulsion device positioned substantially to the rear of the hull.

It is a further object of this invention to provide an improved supporting arrangement for a marine propulsion system of this type.

SUMMARY OF THE INVENTION

This invention is adapted to be embodied in an marine propulsion system that is adapted to be attached at the rear of a watercraft hull for propelling the watercraft. The propulsion system comprises a powering internal combustion engine and a drive shaft housing and lower unit journaling a propeller shaft that is driven by the engine and which extends generally horizontally rearwardly from the watercraft hull. A propulsion device is driven by the rear end of the propeller shaft. Means support the propulsion system for steering and tilting movement about respective vertically and horizontally extending transverse axes which are disposed below and to the rear of the portion of the hull to which the marine propulsion system is attached.

In accordance with a first feature of the invention, a control tiller is affixed to the upper portion of the propulsion system and extends forwardly across the watercraft hull for access by an operator located within the hull. The distance between the tilt axis of the propulsion system and the propeller is slightly longer than the distance between that axis and the front of the tiller.

In accordance with another feature of the invention, the attachment of the propulsion system to the hull is provided by a generally L-shaped bracket having a horizontal leg adapted to be affixed to the hull and a vertical leg extending vertically downwardly toward the water level. A bracket is carried by the lower end of this vertical leg and supports rearwardly thereof a vertically extending steering pin which defines the vertically extending steering axis. A yoke is pivotally supported at its forward end by this steering pin and extends rearwardly to embrace a lower portion of the drive shaft housing and lower unit and to provide the pivotal connection thereto that defines the transverse tilt axis.

DETAILED DESCRIPTION OF THE PREFERRED EMBODIMENTS OF THE INVENTION

Figure 1:
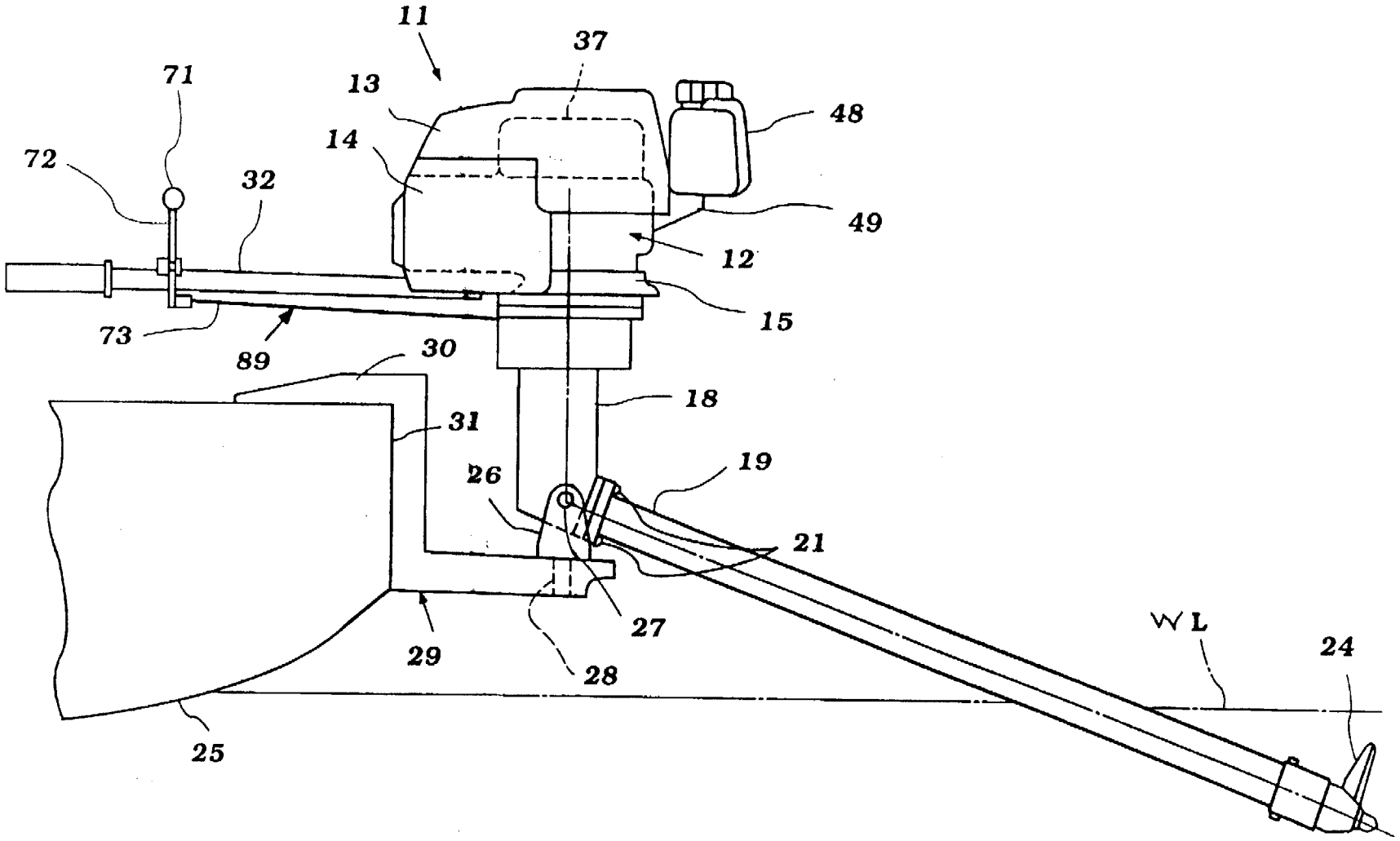
FIG. 1 is a side elevational view of an outboard motor constructed in accordance with an embodiment of the invention mounted to a watercraft.
Figure 2:
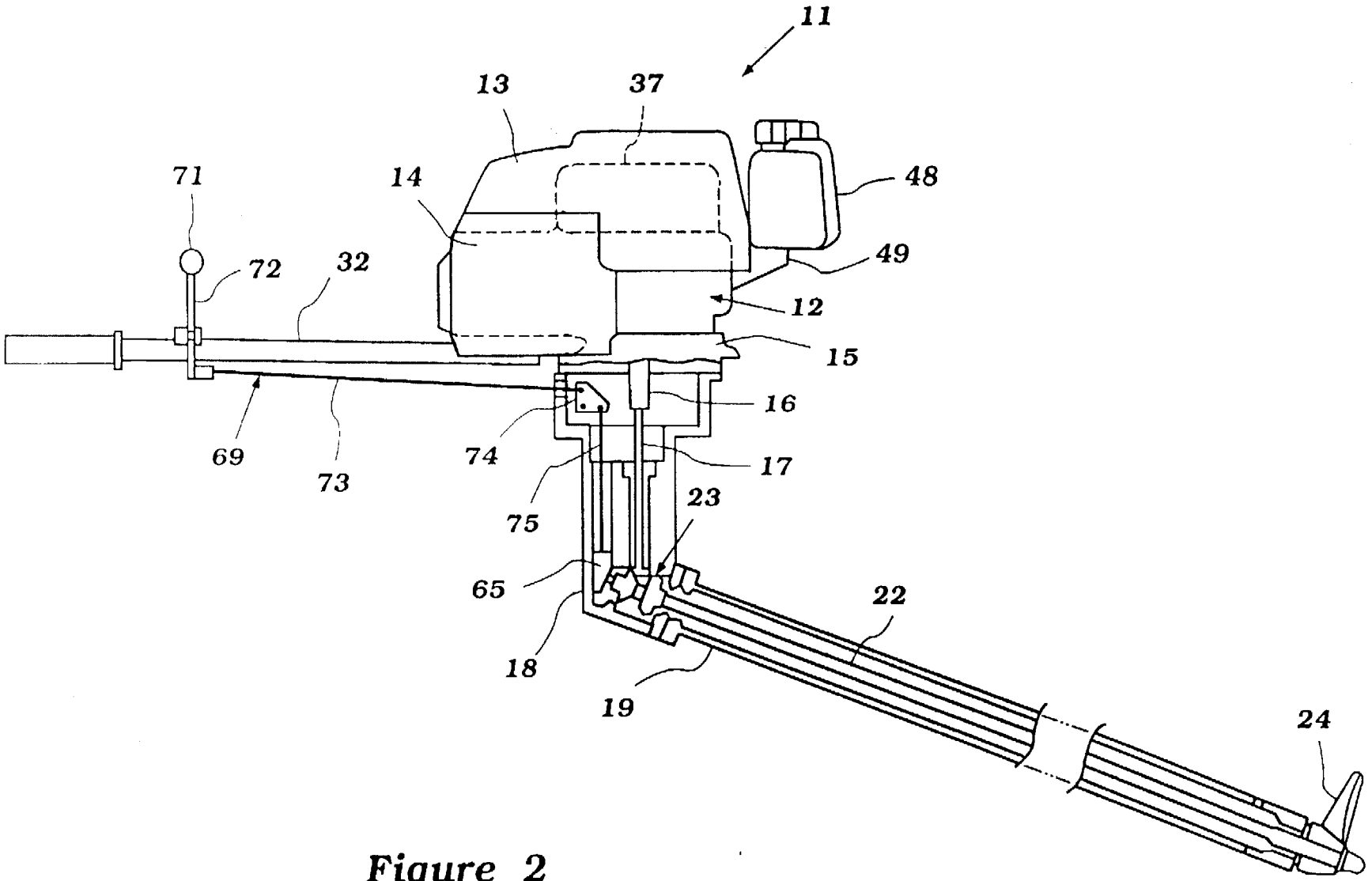
FIG. 2 is a side elevational view of this embodiment with portions of the exterior surfaces removed to show the internal components of the drive assembly.

Referring now to the drawings and initially to FIGS. 1 and 2, an outboard motor constructed in accordance with a first embodiment is identified generally by the reference numeral 11. The outboard motor 11 is comprised of a power head that consists of a powering internal combustion engine indicated generally by the reference numeral 12 and the surrounding protective cowling comprised of an upper cowling portion 13 that is detachably connected to the top of a main cowling portion 14 that is, in turn, detachably connected along its lower end to a tray portion 15.

As is typical with conventional type outboard motor practice, the engine 12 is supported within the power head so that its output shaft, a crankshaft that is indicated by the reference numeral 16, rotates about a generally vertically extending axis. This output shaft, or crankshaft 16, is rotatably coupled to a first drive shaft that is indicated by the reference numeral 17 and is journaled within a first vertically extending drive shaft housing 18 whose upper portion is encircled by the tray 15.

A second drive shaft housing is indicated by the reference numeral 19 and is affixed to the lower end of the first drive shaft housing 18 by means of bolts 21. The second drive shaft housing 19 extends generally downwardly and rearwardly at an obtuse angle to the first drive shaft housing and journals a second drive shaft that is indicated by the reference numeral 22. The drive shaft housings 18 and 19 form together a combined drive shaft housing and lower unit assembly.

At its upper end, the second drive shaft 22 is connected to the first drive shaft 17 through a transmission that is indicated in later figures (2 and 4) by the reference numeral 23 and will be described in detail later by reference to those figures.

At its rearward end, the second drive shaft 22 drives a propulsion device, namely, a propeller 24 through a suitable coupling for driving a watercraft 25 associated with the outboard motor 11 through a body of water.

A bracket 26 is rotatably journaled about a horizontally extending axis at its rearward end by means of a pivot shaft 27 to the lower portion of the first drive shaft housing 18. The bracket 26 is rotatably journaled about a generally vertically extending axis at its forward end by means of a further pivot shaft 28 to the rear of a mounting bracket that is indicated by the reference numeral 29.

The mounting bracket 29 has a horizontal leg 30 that extends across the rear or transom 31 of the watercraft 25. A vertical drop leg of the bracket 29 is affixed by any suitable means to the rear or transom 31 of the watercraft 25. The pivot shaft 28 is journalled on a lower leg of the bracket 29 which is close to the water level.

Thus, with the above connection, the outboard motor 11 may be rotated about a tilt axis defined by the first pivot shaft 27 and about a steering axis defined by the second pivot shaft 28. This rotation is controlled by an operator control tiller that is indicated by the reference numeral 32 and affixed by any suitable means to the lower surface of the main cowling 14.

Figure 3:
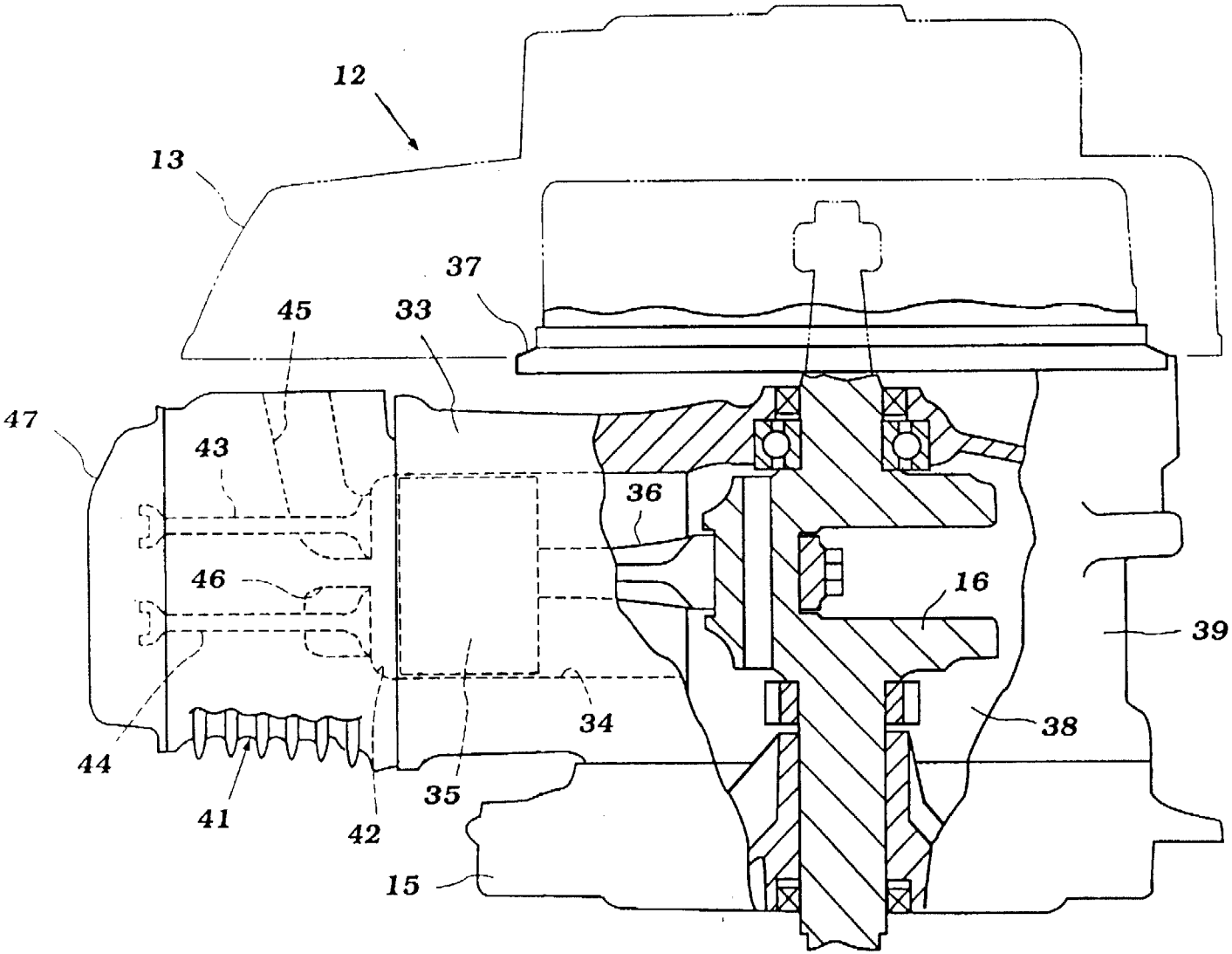
FIG. 3 is an enlarged side elevational view of the powering internal combustion engine with a portions broken away and other portions shown in cross section and certain components shown in phantom.

The internal combustion engine 12 will now be described in detail with reference to FIG. 3. The engine 12 is of a four-stroke type configuration and with a single cylinder, though it should be apparent to those skilled in the art that multi-cylinder engines of various cylinder arrangements may be utilized in conjunction with the invention and that engines of two-stroke configuration may also be employed. The engine 12 is provided with a cylinder block 33 in which a single horizontally extending cylinder bore 34 is formed.

A piston that is indicated by the reference numeral 35 reciprocates within the cylinder bore 34 and is connected to a connecting rod 36 by means of a piston pin (not shown). The lower or big end of the connecting rod 36 is journaled on the throw of the crankshaft 16. At the upper end of the crankshaft 16 there is affixed a flywheel 37. The crankshaft 16 is rotatably journaled about a generally vertical axis within a crankcase chamber 38 formed at the lower end of the cylinder bore 34. The crankcase chamber 38 is formed by the skirt of the cylinder block 33 and a crankcase member 39 that is affixed to the cylinder block 33 in any well known manner.

The end of the cylinder bore 34 opposite the crankcase chamber 38 is closed by means of a cylinder head assembly 41 that is affixed to the cylinder block 33 in any known manner. The cylinder head 41 has recess 42 which cooperates with the cylinder bore 34 and the head of the piston 35 to form a combustion chamber above which is positioned a spark plug (not shown) that has its gap extending into the combustion chamber 42. This combustion chamber has a volume which varies cyclically during the reciprocation of the piston 35 as is well known in this art.

Intake and exhaust valves are indicated by the reference numerals 43 and 44, respectively, and are disposed within the cylinder head 41 above the recess 42 and control intake and exhaust ports 45 and 46 which are formed in the cylinder head 41 and opened to the combustion chamber 42. The intake and exhaust valves 43 and 44 are operated in any known manner by a valve operating mechanism (not shown) located at least in part underneath a valve cover 47 that encloses the upper surface of the cylinder head 16.

An air fuel charge is delivered to the engine's combustion chamber 42 for compression and ignition therein by means of an air fuel charging system (not shown) that is disposed within the protective cowlings 13 and 14 of the power head and which draws air from the atmosphere through an inlet (not shown) of the upper cowling 13. Fuel is supplied to the air fuel charging system from a fuel tank 48 that is mounted to the rear external surface of the power head by a bracket 49.

When the spark plug fires, the charge in the combustion chamber will ignite, burn and expand. This expanding charge drives the piston 35 downwardly to rotate the crankshaft 16 which, in turn, rotates the first drive shaft 17. The second drive shaft 22 is then driven by the first drive shaft 17 through the transmission 23 which causes the propeller 24 to rotate and, thus, drive the watercraft 25. The burnt charge is discharged through the exhaust port 46 and an appropriate exhaust system (not shown).

Figure 4:
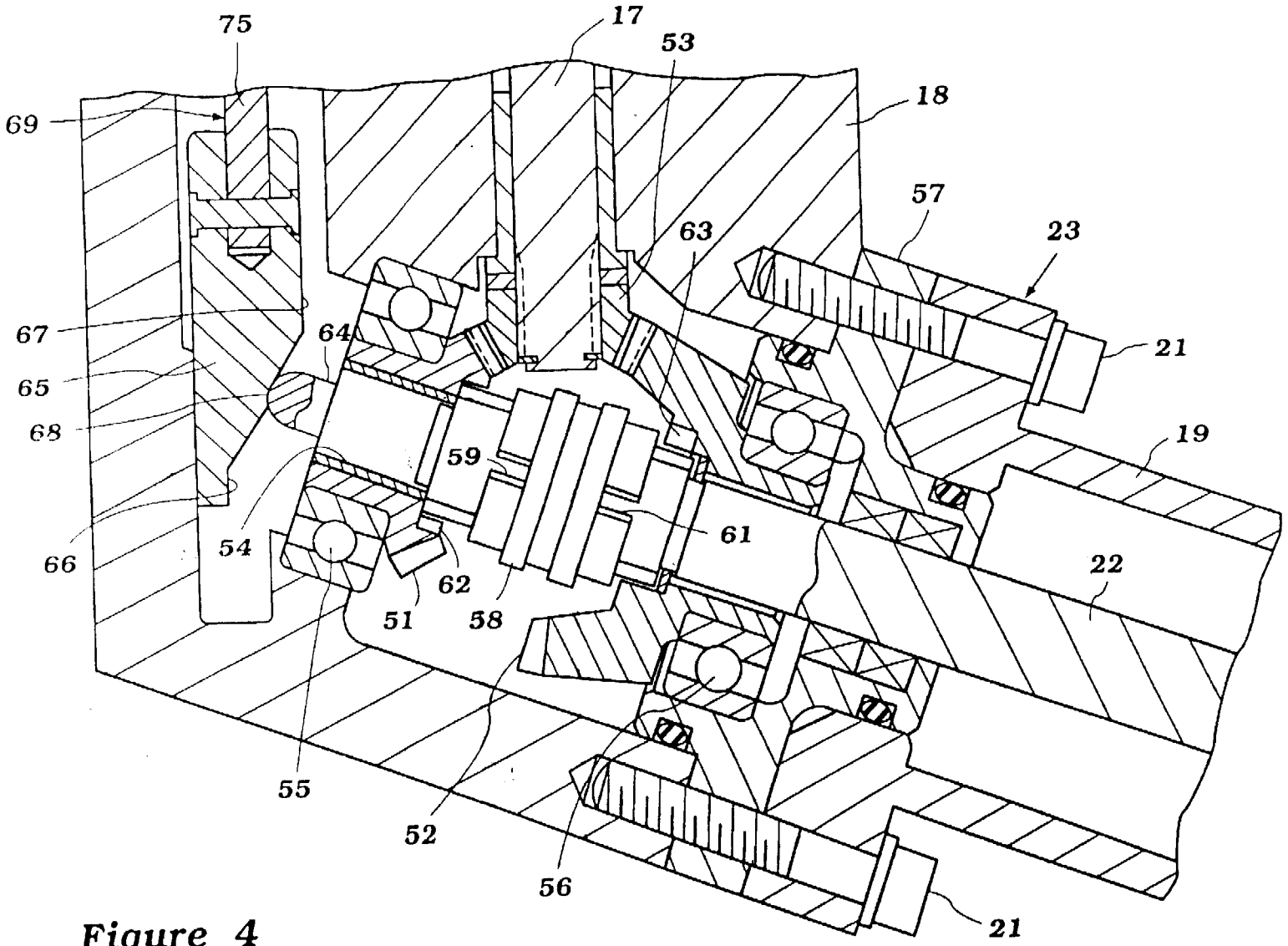
FIG. 4 is a cross-sectional view of the transmission.

The transmission 23 will now be described in detail with reference to FIGS. 2 and 4. The transmission 23 is composed of a first forward driven bevel gear and a second reverse driven bevel gear that are indicated by the reference numerals 51 and 52, respectively, and are axially spaced one from the other. The bevel gears 51 and 52 operatively engage a driving bevel gear 53 that is affixed to the lower end of the first drive shaft 17.

The first bevel gear 51 rotatably journals the upper end of the second drive shaft 22 by means which include a plain type bearing 54. The bevel gear 51 and second drive shaft 22 are rotatably journaled within the first drive shaft housing 18 by means of a ball bearing assembly that is indicated by the reference numeral 55.

The second bevel gear 52 is rotatably journaled by means of a further ball bearing assembly 56 carried by a beating member 57 that has its outer race affixed along its external periphery to both the first and second drive shaft housings 18 and 19 by means of the bolts 21. The inner race of the ball bearing 56 engages a hub of the bevel gear 52. This hub has a central opening through which the second drive shaft 22 extends. Thus, the first and second bevel gears 51 and 52 are driven about the second drive shaft 22 in opposite directions by the driving bevel gear 53.

A dog clutch is indicated by the reference numeral 58 and is axially slidingly splined to the upper end of the second drive shaft 22 between the forward and reverse bevel gears 51 and 52. The dog clutch 58 has forward and reverse engagement slots 59 and 61 for selectively accommodating forward and reverse teeth that are indicated by the reference numerals 62 and 63 and formed in the forward and reverse bevel gears 51 and 52, respectively.

A push rod 64 is connected by a pin (not shown) to the dog clutch 58. The push rod has an upper end that engages a cam 65 disposed in a cavity of the first drive shaft housing 18. The cam surface of the cam 65 is formed with positions corresponding to forward, neutral and reverse gear, and are indicated by the reference numerals 66, 67 and 68, respectively. The operative position of the cam 65 is controlled by a transmission control that is indicated by the reference numeral 69 and will be described in detail later.

The transmission 23 functions in the following manner. When the forward gear cam surface 66 is positioned by the transmission control 69, such that it engages the upper end of the push rod 64, the dog clutch 58 will be forced by a coil spring (not shown) to a position along the second drive shaft 22 where its forward engagement slot 59 engages the forward tooth portion 62 of the forward beveled gear 51. This effectively couples the dog clutch 58 to the forward bevel gear 51 and, thus, couples the second drive shaft 22 to the first drive shaft 17, thus, causing the propeller 24 to drive the watercraft 25 forwardly.

In like manner, when the reverse gear cam surface 68 is in engagement with the push rod 64, the dog clutch 58 will be positioned such that its reverse engagement slot 61 engages the reverse tooth portion 63 of the reverse bevel gear 52. This couples the dog clutch 58 to the reverse bevel gear 52 and, thus, causes the second drive shaft 22 to drive the propeller 24 in the reverse direction. When the neutral gear cam surface 67 is in engagement with the push rod 64, as is shown in FIG. 4, the dog clutch 58 is positioned such that it is not engaged to either of the bevel gears 51 and 52, and the second drive shaft 22 is, thus, not driven.

The position of the cam 65 is controlled by the transmission control 69 which consists of a handle 71 mounted atop a shift lever 72 that is pivotally connected to the tiller 32. A first link 73 is pivotally connected to the lower end of the shift lever 72 (FIG. 2) and extends rearwardly through an opening formed in the first drive shaft housing 18 to pivotally connect to a connecting bracket 74 which is rotatably journaled within the housing 18. A second link 75 is pivotally connected to the bracket 74 and extends downwardly to connect to the cam 65.

By pushing the shift lever 72 rearward, the first link 73 will cause the connecting bracket 74 to rotate counterclockwise. This causes the second link 75 to pull the cam 65 upwardly such that the cam surface forward portion 68 engages the push rod 64 and forward gear is engaged. In like manner, reverse and neutral settings are engaged by positioning the shift lever 72 forwardly and upright, respectively.

Figure 5:
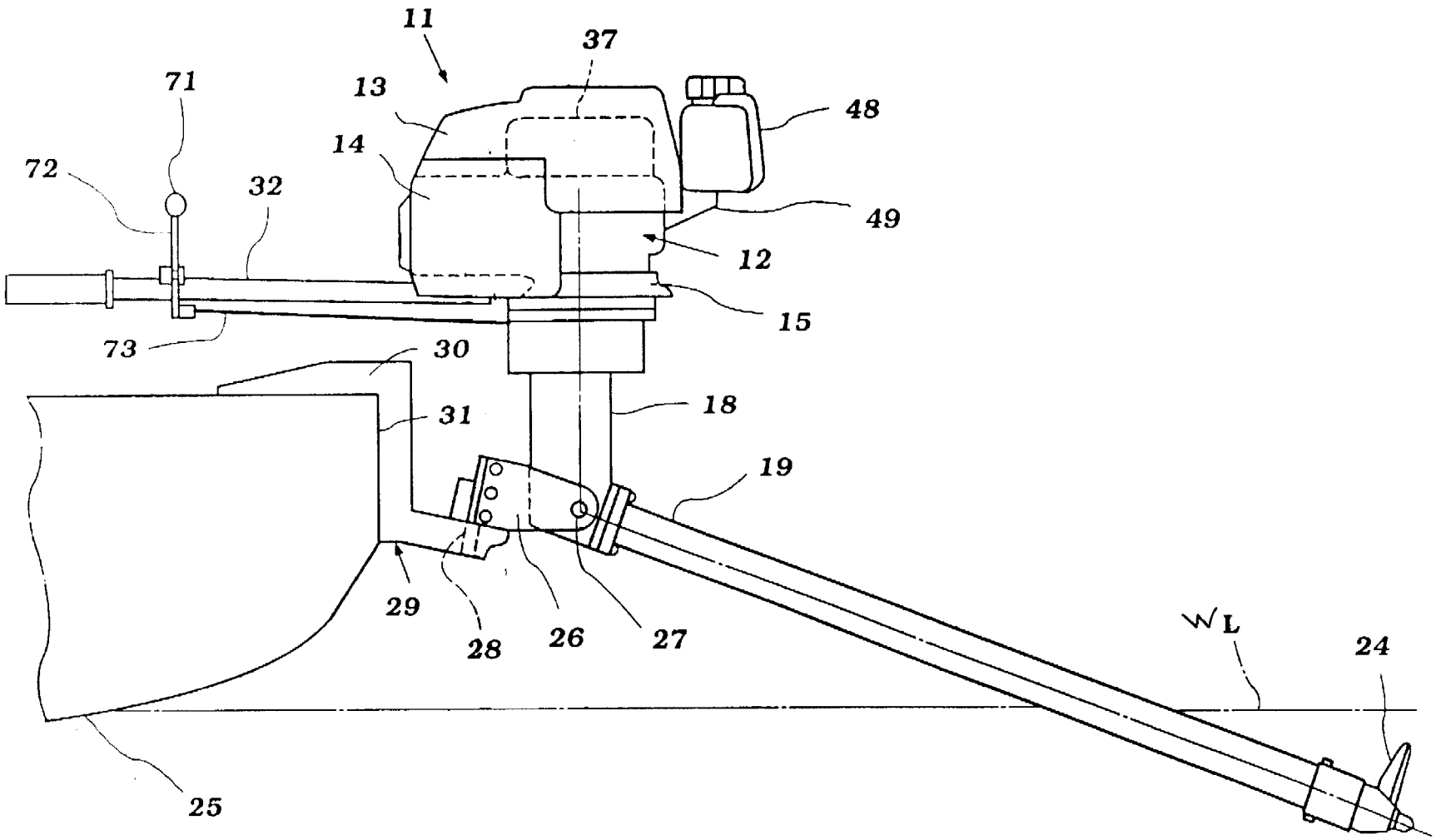
FIG. 5 is a side elevational view of an outboard motor, in part similar to FIG. 1 and showing a second embodiment of the invention.

In FIG. 5, another embodiment of outboard motor generally similar to the configuration illustrated in FIGS. 1–4 is shown. This embodiment varies from the configuration of FIGS. 1–4 in that a different bracket 76 replaces the bracket 26 used to connect the outboard motor 11 to the mounting bracket 29 which has also been modified to extend further rearwardly and further downwardly closer to the water level WL. This embodiment places the steering axis ahead of the tilt axis.

Figure 6:
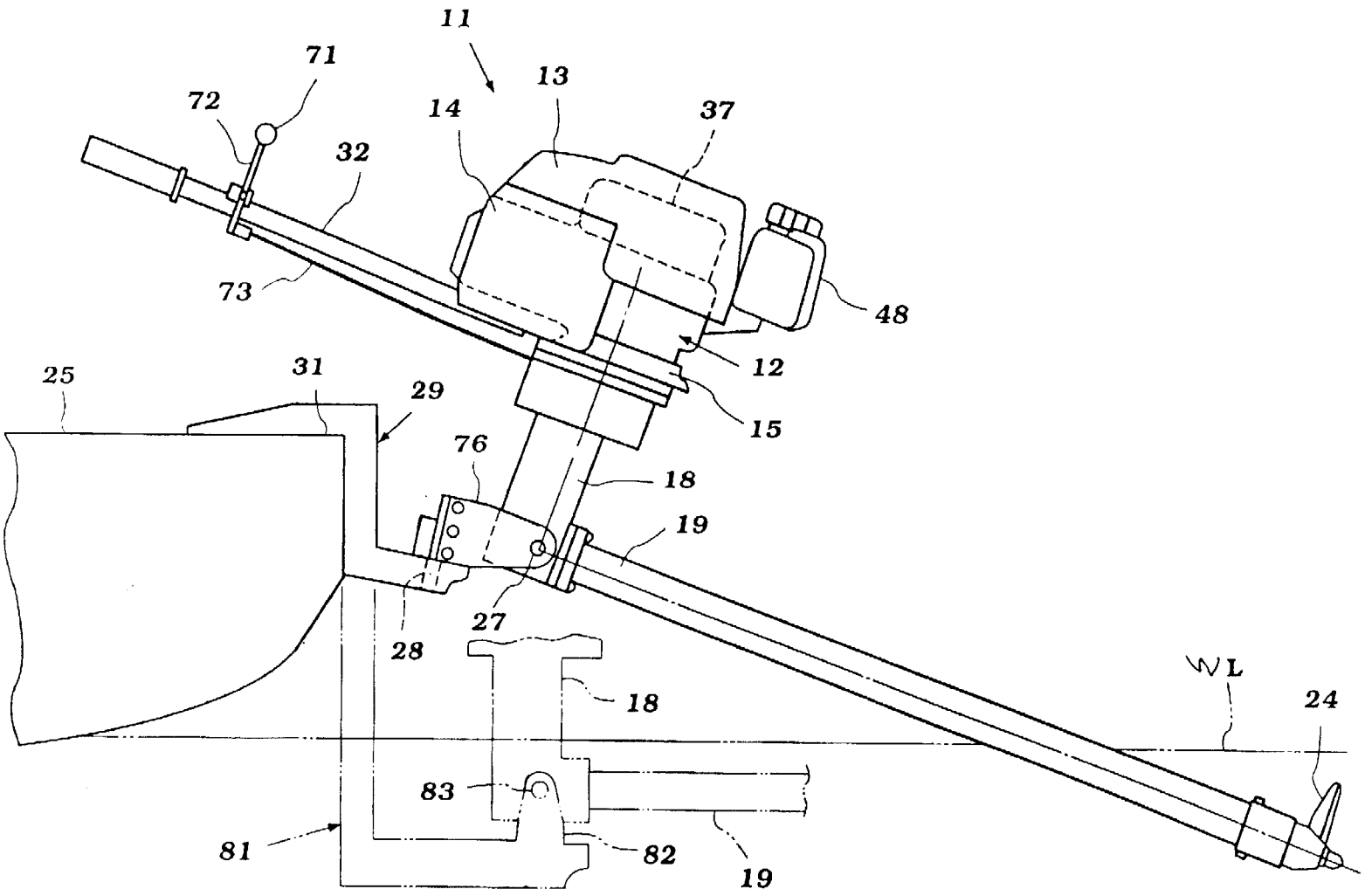
FIG. 6 is a side elevational view of an outboard motor, in part similar to FIGS. 1 and 5, constructed accordance with another embodiment of the invention.

A further configuration is illustrated in FIG. 6 where the brackets 76 and 29 are retained, but the outboard motor 11 has been modified such that the second drive shaft housing 19 is oriented orthogonal to the axis of the first drive shaft housing 18. This means that the upper portion of the outboard motor 11 must be oriented at some angle from vertical in order to position the propeller 24 below the level of the water WL from the driving of the watercraft 25.

All of the above-described outboard motor configurations dispose the steering and trim axes substantially below the upper edge of the transom 31 and close to the water level. FIG. 6 shows in phantom another embodiment of mounting bracket that permits the horizontal tilt axis to be disposed below the water level WL.

A mounting bracket constructed in accordance with this embodiment of the invention is indicated by the reference numeral 81 and extends below the water level WL. A second bracket 82 is pivotally connected about a vertical axis to the mounting bracket 81 at its rear-most end and rotatably journals the first drive shaft housing 18 of the outboard motor 11 about a horizontal axis by means of a pivot shaft 83.

With the above-described configuration, it is seen that the second drive shaft housing 19 is completely submerged below the water level WL and disposed horizontally. This increases the effective propulsive drive force and also allows the propeller 24 to be easily tilted above the water level WL in those situations where it is necessary to do so, such as when to avoid any obstacles floating at water level or the like.

Figure 7:
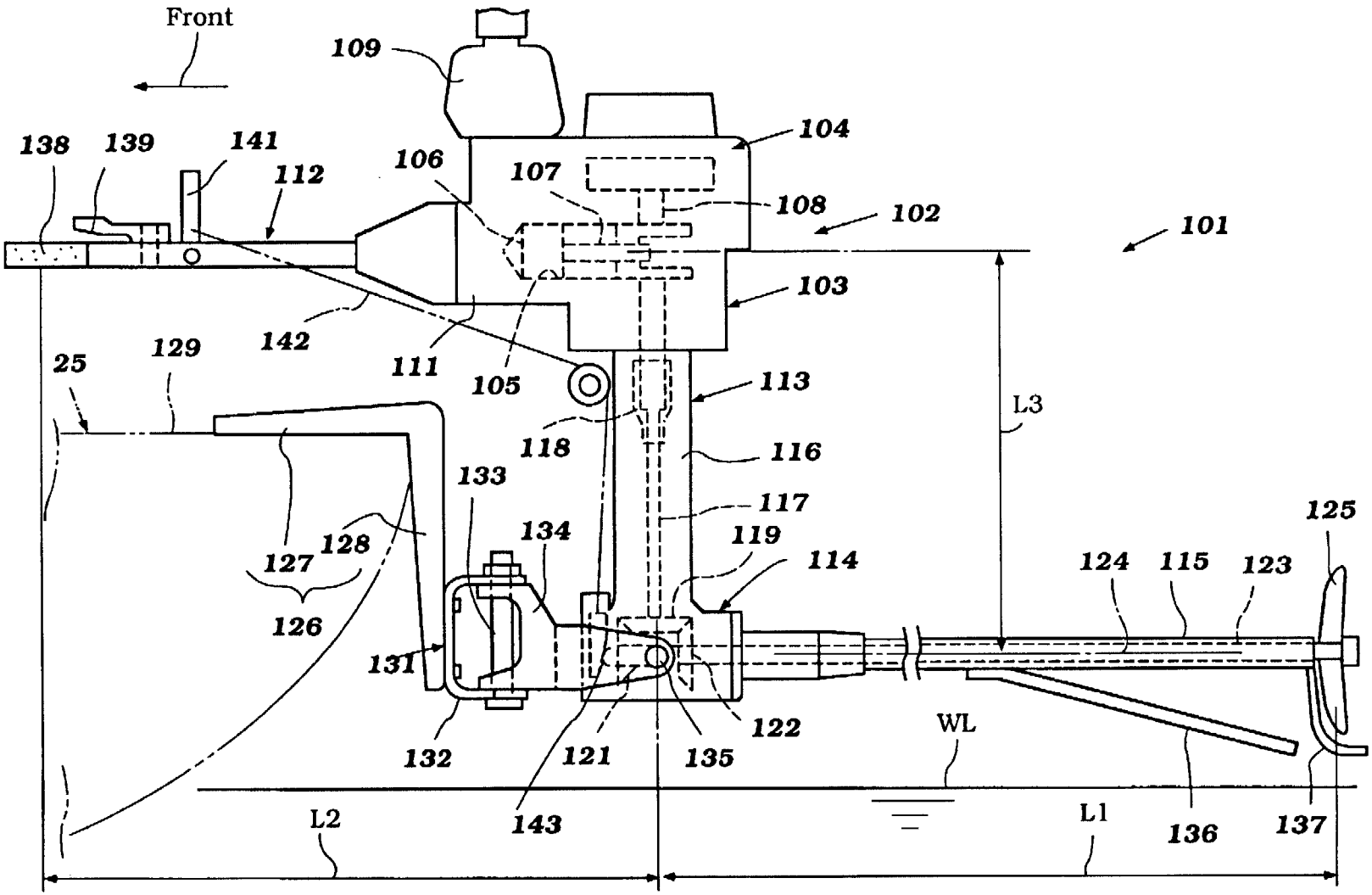
FIG. 7 is a side elevational view of an outboard motor, in part similar to FIGS. 1, 5 and 6, constructed in accordance with still another embodiment of the invention.

A still further embodiment of the invention is shown in FIG. 7 and includes an outboard motor assembly, indicated generally by the reference numeral 101. The outboard motor assembly 101 includes a powerhead, indicated generally by the reference numeral 102, that is comprised of an outer housing assembly 103 in which an internal combustion engine, shown partially and indicated by the reference numeral 104 is contained.

In this embodiment, the engine 104 is depicted as being of the single cylinder, two-cycle, crankcase compression type. Thus, it is formed with a cylinder block that has a horizontally disposed cylinder bore 105 in which a piston 106 rotates. The piston 106 is connected to a connecting rod 107 which, in turn, drives a crankshaft 108 that rotates about a vertically disposed axis.

A fuel tank 109 for the engine 104 is mounted on the upper portion of a forwardly extending part 111 of the powerhead housing 103. A tiller assembly 112 extends generally in a horizontal direction forwardly for control by the operator in a manner which will be described.

A combined drive shaft housing lower unit assembly 113 depends from the powerhead 102. This assembly includes a rearwardly extending portion 114 to which a tubular extension 115 is affixed. This tubular extension 115 extends in a generally parallel relationship to the tiller 112 but in the opposite direction.

A vertically extending tubular part 116 of the drive shaft housing lower unit assembly 113 journals a first drive shaft 117. This first drive shaft 117 has a spline connection 118 to the lower end of the crankshaft 108.

A bevel gear 119 is affixed to the lower end of the drive shaft 117 and drives a pair of counter rotating bevel gears 121 and 122 of a reversing transmission. A dog clutching assembly (not shown) is provided for selectively coupling the gears 121 or 122 to a propeller shaft 123 that is journaled at its forward and in the lower unit portion 114 of the drive shaft housing lower unit assembly 113.

This propeller shaft 123 rotates about a longitudinally extending axis 124 which is also parallel to the tiller 112. The axis 124 also extends generally parallel to the water level WL when the tiller 112 is in a horizontal direction. A propeller 125 is fixed for rotation at the rear end of the propeller shaft 123 and adjacent the termination of the outer or rearward end of the tubular member 115.

A supporting bracket assembly 126 fixes the outboard motor 101 for operation on the rear of the hull 25. This bracket 125 includes, as with the previously described embodiments, a horizontally extending leg 127 and a vertically extending leg 128. The horizontally extending leg 127 extends over an upper surface 129 of the hull 25 and is connected thereto.

A mounting assembly, indicated generally by the reference numeral 131 is mounted at the lower end of the mounting bracket leg 128 and provides the steering and tilt pivotal axes for the outboard motor 101.

This mounting assembly 131 includes a generally C-shaped, rearwardly facing bracket 132 that journals a steering shaft 133 that extends generally vertically. A yoke assembly 134 is pivotally journaled on the steering shaft 133 for steering of the outboard motor 101 about the vertically extending steering axis defined by the steering shaft 123. Operation of the tiller handle 112 will effect the steering as aforenoted.

The yoke 134 has a rearwardly extending bifurcated portion that encircles the portion 114 of the drive shaft housing and lower unit 113. A pair of pivot pins 135 provide a pivotal connection between the yoke 134 and the drive shaft housing and lower unit 113 so as to accommodate the trim motion about the transversely extending trim axis, as with the previously described embodiments. Again, this motion is controlled by the tiller 112.

It should be noted that the tubular member 125 carries a first angularly inclined protecting bracket 136 which will engage underwater objects or the shore when the watercraft is being beached so as to avoid damage to the propeller 125. A further, rear guard 137 is fixed to the lower end of the tubular member 115 adjacent the propeller 125 to provide still further protection.

It should be noted that the tilt pivot axis defined by the pivot pins 135 forms a point from which the tiller 112 extends forwardly for a distance L2 with the propeller 125 extending a distance L1 to the rear of this pivot axis. This arrangement is such that L1 is greater than but not substantially greater than L2. This is possible because of the fact that the propeller shaft 123 and its supporting tubular member 115 extend generally horizontally. This shortening of the overall length permits the watercraft to be maneuvered in very narrow waterways without the propeller 125 striking the shore or the bowel of the watercraft striking the shore.

The vertical distance L3 between the propeller shaft axis 124 and the tiller 112 is less than either of the distances L1 and L2 so as to maintain a compact construction.

Finally, the tiller 112 has a forwardly extending hand grip portion 138 that an operator may grasp to provide both the steering and tilt operation. A throttle control lever 139 is mounted to the rear of the hand grip 138 and is connected by an appropriate linkage or wire actuator to the throttle valve of the engine 104 for its control.

A shift control lever 141 is mounted to the rear of the throttle control 139 and is connected by means of a wire cable 142 to a shift control cam 143 mounted in the lower unit portion 114. This shift cam 143 is associated with a shift mechanism for operating the dog clutching elements for driving the propeller shaft 123 and propeller 125 in the forward and reverse directions in the manners already described.

From the foregoing, it should be readily apparent that the above-described marine propulsive systems allow the easy tilting motion of an outboard motor about a horizontal axis that is disposed close to or below the level of the water in which the watercraft driven by the outboard motor is operating. They also permit the use of powering engines having generally vertically extending output shafts.

Of course, the foregoing description is that of preferred embodiments of the invention and it will be readily apparent to those skilled in the art how various changes and modifications may be made from the described embodiments without departing from the spirit and scope of the invention as defined by the appended claims.

What is claimed is:

1. A marine propulsion system adapted to be attached at the rear of a watercraft hull for propelling the watercraft, said propulsion system comprising a powering internal combustion engine, a drive shaft housing and lower unit journaling a propeller shaft that is driven by said engine and which extends generally horizontally rearwardly from the watercraft hull, a propulsion device driven by the rear end of the propeller shaft, means for supporting said propulsion system for steering and tilting movement about respective vertically and horizontally extending transverse axes which are disposed below and to the rear of the portion of the hull to which the marine propulsion system is attached, and a tiller affixed to the upper end of said drive shaft housing and lower unit and extending forwardly into the watercraft for operator control of the steering and trim of said propulsion system, the distance between said trim axis and the propulsion device being greater than the distance between the forward end of the tiller and said trim axis.

2. A marine propulsion system as set forth in claim 1, wherein the tiller and the propeller shaft are parallel to each other.

3. A marine propulsion system as set forth in claim 2, wherein the axis about which the propeller shaft rotates intersects the trim axis.

4. A marine propulsion system as set forth in claim 3, wherein the steering axis and the tilt axis do not intersect each other.

5. A marine propulsion system as set forth in claim 4, wherein the steering axis and the tilt axis are spaced longitudinally from each other.

6. A marine propulsion system as set forth in claim 5, wherein the tilt axis is disposed to the rear of the steering axis.

7. A marine propulsion system as set forth in claim 5, wherein attachment of the propulsion system to the hull is provided by a generally L-shaped bracket having a horizontal leg adapted to be affixed to the hull and a vertical leg extending vertically downwardly toward the water level, a bracket carried by the lower end of said vertical leg, said vertical leg supporting rearwardly thereof a vertically extending steering pin which defines said vertically extending steering axis, a yoke pivotally supported at its forward end by said steering pin and extending rearwardly therefrom to embrace a lower portion of the drive shaft housing and lower unit and to provide the pivotal connection thereto that defines the transverse tilt axis.

8. A marine propulsion system adapted to be attached at the rear of a watercraft hull for propelling the watercraft, said propulsion system comprising a powering internal combustion engine, a drive shaft housing and lower unit journaling a propeller shaft that is driven by said engine and which extends generally horizontally rearwardly from the watercraft hull, a propulsion device driven by the rear end of the propeller shaft, means for supporting said propulsion system for steering and tilting movement about respective vertically and horizontally extending transverse axes which are disposed below and to the rear of the portion of the hull to which the marine propulsion system is attached, a tiller affixed to the upper end of said drive shaft housing and lower unit and extending forwardly into the watercraft for operator control of the steering and trim of said propulsion system, a generally L-shaped bracket having a horizontal leg adapted to be affixed to the hull and a vertical leg extending vertically downwardly toward the water level, a bracket carried by the lower end of said vertical leg, said vertical leg supporting rearwardly thereof a vertically extending steering pin which defines said vertically extending steering axis, and a yoke pivotally supported at its forward end by said steering pin and extending rearwardly therefrom to embrace a lower portion of said drive shaft housing and lower unit and to provide the pivotal connection thereto that defines said transverse trim axis.

* * * * *